US007993574B2

(12) United States Patent
Wisdom et al.

(10) Patent No.: US 7,993,574 B2
(45) Date of Patent: Aug. 9, 2011

(54) BOARD LINED FURNACE WITH SIDE IMMERSION HEATING ELEMENTS

(75) Inventors: Andrew Wisdom, Eau Claire, MI (US); Robert Janney, Benton Harbor, MI (US)

(73) Assignee: SPX Corporation, Charlotte, NC (US)

( * ) Notice: Subject to any disclaimer, the term of this patent is extended or adjusted under 35 U.S.C. 154(b) by 550 days.

(21) Appl. No.: 12/038,465

(22) Filed: Feb. 27, 2008

(65) Prior Publication Data

US 2009/0212471 A1 Aug. 27, 2009

(51) Int. Cl.

| | |
|---|---|
| ***C22B 7/00*** | (2006.01) |
| *C21C 5/48* | (2006.01) |
| *F27D 7/00* | (2006.01) |
| *F27D 9/00* | (2006.01) |
| *F27D 13/00* | (2006.01) |

(52) U.S. Cl. ..... 266/242; 266/272; 432/4

(58) Field of Classification Search ..... 266/242, 266/272; 432/4

See application file for complete search history.

(56) References Cited

U.S. PATENT DOCUMENTS

| | | | | |
|---|---|---|---|---|
| 2,400,618 | A * | 5/1946 | Wicks | 392/314 |
| 4,319,127 | A * | 3/1982 | Lindstrom et al. | 219/523 |
| 5,120,029 | A * | 6/1992 | Durbin | 266/275 |
| 5,286,009 | A * | 2/1994 | Moore et al. | 266/236 |

FOREIGN PATENT DOCUMENTS

JP 11-347720 * 12/1999

* cited by examiner

*Primary Examiner* — Jessica L Ward
*Assistant Examiner* — Alexander Polyansky
(74) *Attorney, Agent, or Firm* — Baker & Hostetler LLP

(57) ABSTRACT

A holding furnace for holding a molten metal includes a housing having an interior chamber for holding the molten metal. An insulating board structure is placed into the chamber along at least a side portion of the housing. The insulating board structure contains heat within the housing for maintaining the metal in a molten state. A heater assembly is provided in a side of the furnace. The heater assembly is installed in the side of the furnace with a structural arrangement that protects against leakage of molten metal from the furnace interior to the furnace exterior.

22 Claims, 8 Drawing Sheets

BOARD LINED FURNACE WITH SIDE IMMERSION HEATING ELEMENTS

FIELD OF THE INVENTION

The disclosure relates generally to board lined furnaces, and more particularly to side immersion heating elements disposed in sealing relation to the board lined furnaces.

BACKGROUND OF THE INVENTION

Holding furnaces are reservoirs for holding and maintaining molten material in its molten state. There are generally two types of holding furnaces: castable lined holding furnaces and board lined holding furnaces. Within these groups, there are many types and grades of non-wetting castable refractory and non-wetting insulating refractory available. A board lined furnace, for example, may be lined with calcium silicate boards or blocks, but it may also be lined with many other different materials that are interchangeable with the calcium silicate. The calcium silicate board lined holding furnaces, however, are generally considered to be more energy efficient than the traditional castable lined holding furnaces.

SUMMARY OF THE INVENTION

At least one embodiment of the invention is a holding furnace for holding a molten metal. The furnace comprises a housing having an interior chamber for holding the molten metal and an opening into the chamber. An insulating board structure is disposed within the chamber in overlying relation to at least a side portion of the housing. The insulating board structure is constructed and arranged to contain heat within the housing for maintaining the metal in a molten state. A heater assembly extends through a side opening of the housing and through a side opening in the insulating board structure into the chamber. The heater assembly is constructed and arranged to be immersed in the molten metal and to transfer heat thereto. A sealing device is disposed in sealing relation to the housing and to the insulating board structure and arranged in the side openings in the housing and the insulating board structure, the sealing device being configured to support the heater assembly.

Other embodiments provide a holding furnace for holding a molten metal. The furnace comprises a housing having an interior chamber for holding the molten metal and an opening into the chamber. An insulating board structure is disposed within the chamber in overlying relation to at least a side portion of the housing. The insulating board structure is constructed and arranged to contain heat within the housing for maintaining the metal in a molten state. A heater assembly extends through a side opening of the housing and through a side opening in the insulating board structure into the chamber. The heater assembly is constructed and arranged to be immersed in the molten metal and to transfer heat thereto. A sealing means is disposed in sealing relation to the housing and to the insulating board structure and arranged in the side openings in the housing and the insulating board structure, the sealing means being configured to support the heater assembly.

Still other embodiments comprise a method of heating a board lined furnace. The method comprises heating an interior of the furnace with a heater assembly provided through a side wall of the furnace, and retaining the heat in the interior of the furnace by lining the interior of the furnace with an insulating board structure.

Yet other embodiments comprise a sealing device for sealing an opening provided in a side wall of a board lined holding furnace having a fluid sealing surface having a stepped portion configured to inhibit fluid flow along an exterior surface of the sealing device and configured to be disposed in fluid sealing relation to a housing of the furnace; and a supporting portion having another stepped portion configured to inhibit fluid flow along an interior surface of the sealing device, the supporting portion being configured to support a furnace heater arranged therein.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
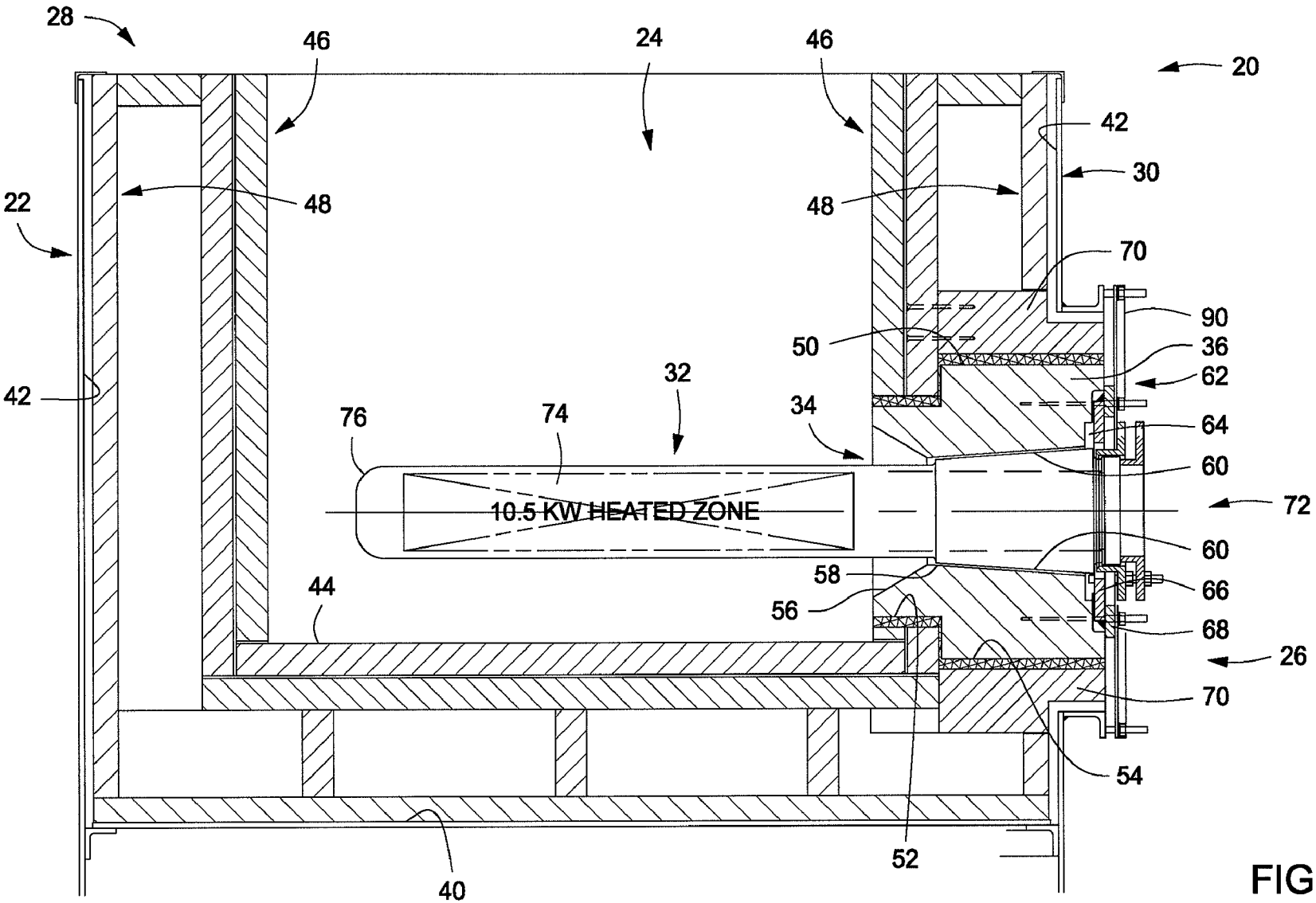
FIG. 1 is a cross-sectional view of a board lined furnace with a heater assembly installed in a side portion according to an embodiment of the invention.

Some of the principles of the disclosure are embodied in a holding furnace 20 for holding molten metal. The furnace 20 generally comprises a housing 22 having an interior chamber 24, a side opening 26 into the chamber 24, an insulating board structure 28 disposed within the chamber 24, a heater assembly 32 extending through the side opening 26 into the chamber 24, and a sealing device 36 to seal the opening 26.

The invention will now be described with reference to the drawing figures, in which like numerals refer to like parts throughout. FIG. 1 shows a cross-sectional view of a board lined furnace according to principles of the invention. The furnace 20 includes the housing 22 having a housing floor 40, a side wall 42 and an insulating cover (not shown). The housing 22 may be constructed of a metallic material as, for example, steel or any other suitable material. The housing 22 includes the interior chamber 24 and side opening 26 which provides access to the chamber 24. The interior chamber 24 is a reservoir for containing molten metal or metal that is to be melted into a molten condition. The insulating board structure 28 generally lines the interior of the chamber 24 and provides a furnace floor 44. The insulating board structure 28 is preferably formed of calcium silicate, although any other suitable high temperature non-wetting insulating refractory material may be used. In the example embodiment, the board lined furnace 20 includes an insulating board structure 28 having an inner assembly of boards 46, an outer assembly of boards 48, and a board containment box 70. The inner assembly of boards may be two layers of calcium silicate board that in part form an inner double box assembly, for example. The outer assembly of boards may be made from vermiculite, for example. Generally, the inner assembly of boards and the outer assembly of boards are fastened together with screws and have refractory sealed joints. The board containment box 70 is built between the inner double box assembly of the inner assembly of boards 46 and the housing 22 of the furnace 20. The board containment box 70 is formed of calcium silicate or any other suitable non-wetting insulating refractory material. The board containment box 70 is constructed the same way as the inner double box assembly so that it will not leak molten metal if the molten metal should make it that far.

The sealing device 36 is used to mount the heater assembly 32 in the side openings 26, 34 provided in the housing 22 and the insulating board structure 28, respectively. The sealing device 36 shown FIG. 1 is one example of a sealing means. The sealing device 36 may be constructed of a calcium silicate block or any other suitable high temperature non-wetting insulating refractory material, and is machined to fit into the side openings 26, 34. The sealing device 36 is configured with a side opening 72.

In the example embodiment, the sealing device 36 may be constructed so that an exterior surface 50 thereof is configured to form a multiple step joint shared with the containment box 70 and the inner double box assembly of the inner assembly of boards 46 to seal out leaks when assembled in the furnace 20. The exterior surface 50 of the sealing device 36 may be constructed with different sized diameter circular or square portions 52, 54, respectively, forming the multiple step joint. However, there other step join configurations are possible in keeping with the principles of the invention. The multiple step joint impedes fluid flow and ensures that there is no straight passage for fluid, such as molten metal, to flow from inside the chamber 24 to the exterior of the furnace 20. An interior portion of the sealing device is constructed with a short tapered cone 56 facing the interior chamber 24 of the furnace 20 and the molten metal therein. The tapered cone 56 allows for the entire heated section of the heater assembly 32 to come in contact with the molten metal. The rectangular box shown on the heater assembly 32 that is nearly even with the interior in the chamber 24 represents the heated section. An adjacent portion of the sealing device 36 is configured with a longer tapered cone 58, which may taper at a different angle than the first tapered cone 56 and may be longer or shorter or the same length as the first tapered cone 56. This second tapered cone 58 in this example embodiment is dimensioned to fit and receive the heater assembly 32. As shown in the example embodiment, the second tapered cone 58 of the sealing block 36 matches and receives a tapered section 60 of the heater assembly 32. There can be different taper angles and taper lengths used for different sizes of heater assemblies 32, but the taper 58 in the sealing block 36 preferably matches the taper section 60 of the heater assembly 32 in order to obtain a good seal between them.

Along a terminal end 62 of the sealing device 36, the end furthest away from the chamber 24, is another stepped or recessed portion 64 formed along an interior portion of the sealing device 36. This recessed portion 64 of the sealing device 36 is designed to accommodate plates 66, 68 mounted thereto, for example, by welding. The plates may be steel plates or manufactured from any other suitable material. The plates 66, 68 aide in the assembly process to mount the sealing device 36 to the housing 22 of the furnace 20.

The heater assembly 32 is provided in the side opening 72 in the sealing device 36, and side openings 26, 34 in the housing 22 and inner board assembly 28, respectively. The heater assembly 32 consists of a heating element 74 and a protective casing 76, for example, an immersion protection tube. The heating element may be an electric heating element or may be a gas fired heating element. It is not necessary that the protective casing 76 be tube-shaped. It may be any other suitable shape including square.

The immersion protection tube 76 is formed of a refractory, for example, manufactured to be fully immersible in the molten metal bath while at the same time protecting the heating element 74. The heater protection tube 76 is sealed in the refractory lining to keep the molten metal from leaking out of the furnace 20. The heater protection tube 76 is thus provided with a tapered sealing cone 60 close to the open end facing toward the exterior of the furnace 20 that provides a stepped sealing joint. As noted above, the sealing device 36, in this example embodiment, is a machined calcium silicate block, and the tapered sealing cone 58 matches the taper 60 of the immersion protection tube 76. This structural arrangement allows the sealing device 36 to be screwed and/or glued to the insulating board structure 28. Any gap that may exist between the sealing device 36 and the immersion protection tube 76 (i.e., the tapered joint between the sealing device 36 and the immersion protection tube 76), is sealed with a refractory fiber gasket or cone, for example, or sealed in any other suitable manner including with any other suitable sealing material.

Figure 11:
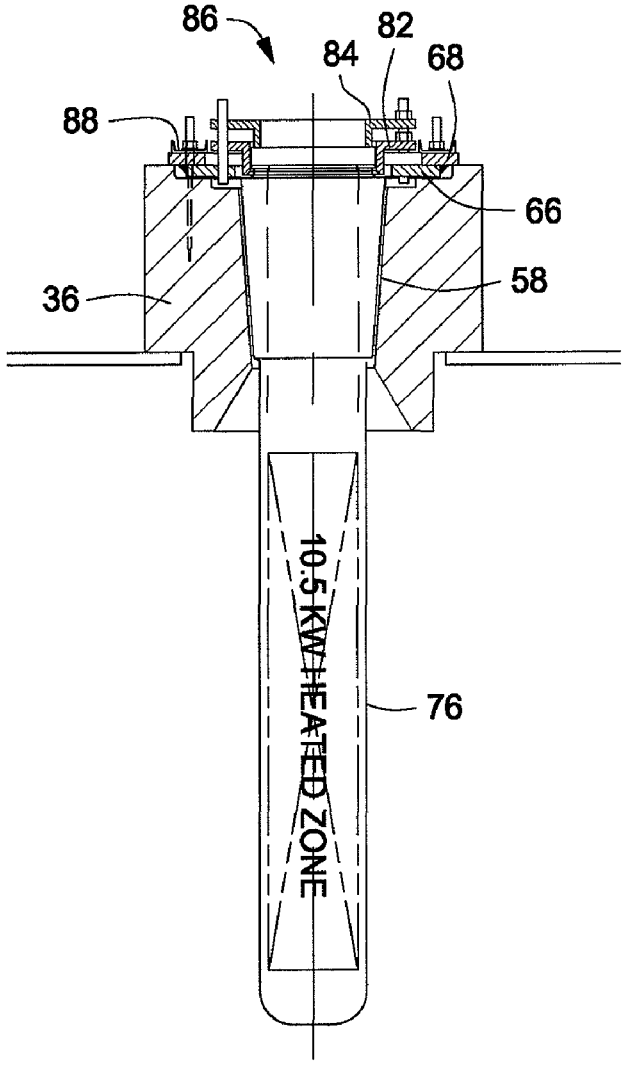
FIG. 11 is a side view of the sealing device shown in FIG. 9 with a heater assembly mounted thereto with temporary holding rails according to an embodiment of the invention.

The heating element 74 is contained in the immersion protection tube 76. The heating element 74 may have any length, and as shown in the example embodiment may have a length that extends through a majority of the immersion protection tube 76 to provide for a large heated area of the immersion protection tube 76 for heating the furnace 20. Further, both the immersion protection tube 76 and the heater element 74 are provided with annular flanges 82, 84 (FIG. 11), respectively, at a terminal end thereof to allow for mounting of the immersion protection tube 76 and heater element 74 to the sealing device 36 providing further protection against leaks. The heating element 74 may have a non-wetting refractory plug 86 (FIG. 11) near the terminal end thereof that is designed to stop the molten metal in the case of tube 76 failure. It is to be understood that the heater assembly may have varying configurations, such as with or without a terminal plug, and that the configuration of the heater assembly shown in the example embodiment is not intended to be limiting in any way.

Figure 2:
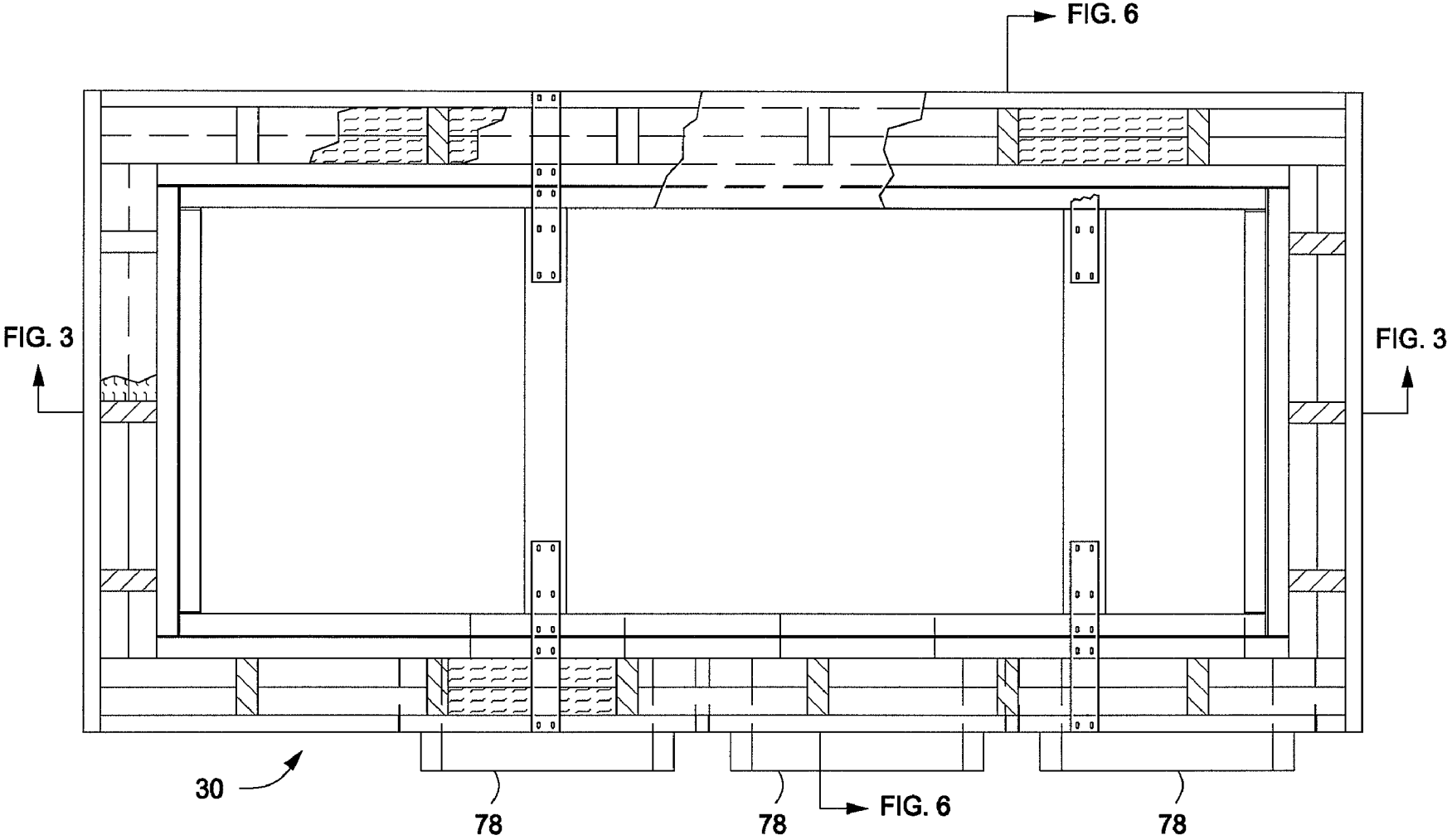
FIG. 2 is a fragmentary top view of the board lined furnace shown in FIG. 1 indicating structure to accommodate three heating elements in a side portion thereof according to an embodiment of the invention.
Figure 3:
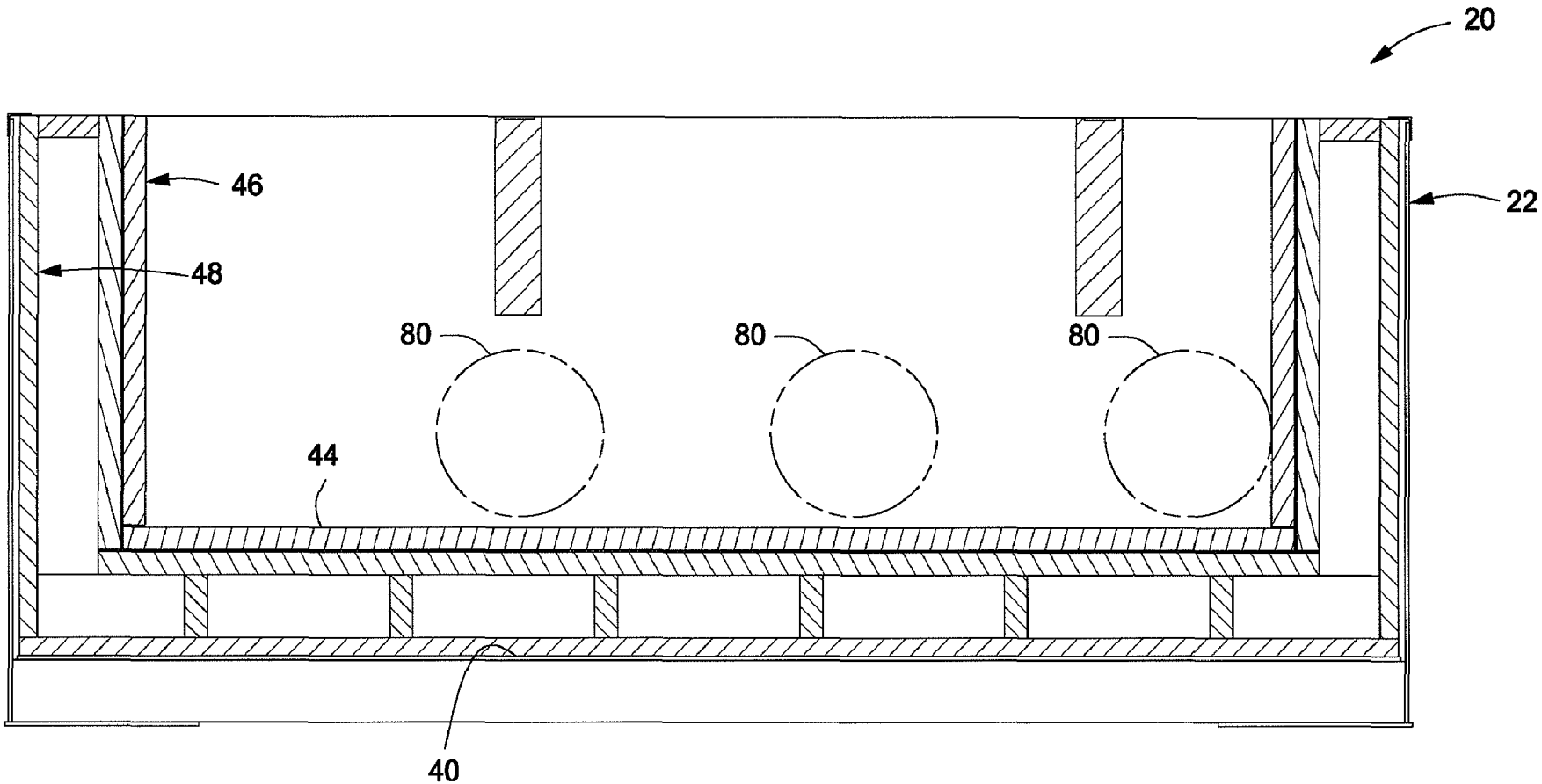
FIG. 3 is a cross-sectional view along line A-A of the board lined furnace shown in FIG. 2 showing openings in a side portion thereof for accommodating three heating elements according to an embodiment of the invention.

In the example embodiment shown in FIG. 1, the heated section of the heating element 74 is marked by a box and with the words 10.5 KW HEATED ZONE. It is to be understood that a range of heater assemblies providing wattages other than the 10.5 kw example heater assembly may be used. The 10.5 kw stands for 10.5 kilowatts or 10,500 watts. The heated zone is the rectangular box shown on the tube that is nearly even with the inside furnace refractory face of the chamber 24 out to near the closed end of the immersion protection tube 76. From the line where the heated zone begins to the outside terminals of the heating element 74 is what is referred to as the cold zone. Each heating element 74, in the example embodiment, has 10.5 kw output. So if, for example, there were three heating elements 74 provided, the total heating capacity would be 31.5 kw total output to the furnace 20. As shown in FIGS. 2 and 3 by structures 78 and openings 80 of the furnace 20, the furnace 20 could be modified to accommodate more than one heating element 74, in this case three heating elements 74, to increase the heating capacity of the furnace 20.

Providing an immersion heating element 74 and immersion protection tube 76 directly in the molten metal bath and in particular arranging them in a side wall 30 of the furnace 20 close to the furnace floor 44 so that they may be fully immersed in the molten metal bath is a very efficient means for heat transfer from the heating element 74 to the molten metal bath. This structural arrangement provides a higher power input through a much larger heating surface to be in contact with the molten metal providing very efficient heat transfer. Since the heater assembly 32 is inserted through a side wall 30 close to the furnace floor 44, the normal variations in bath depth between charges of molten metal does not expose the heating element 74 and immersion protection tube 76 to air which is a poor conductor of heat.

Figure 4:
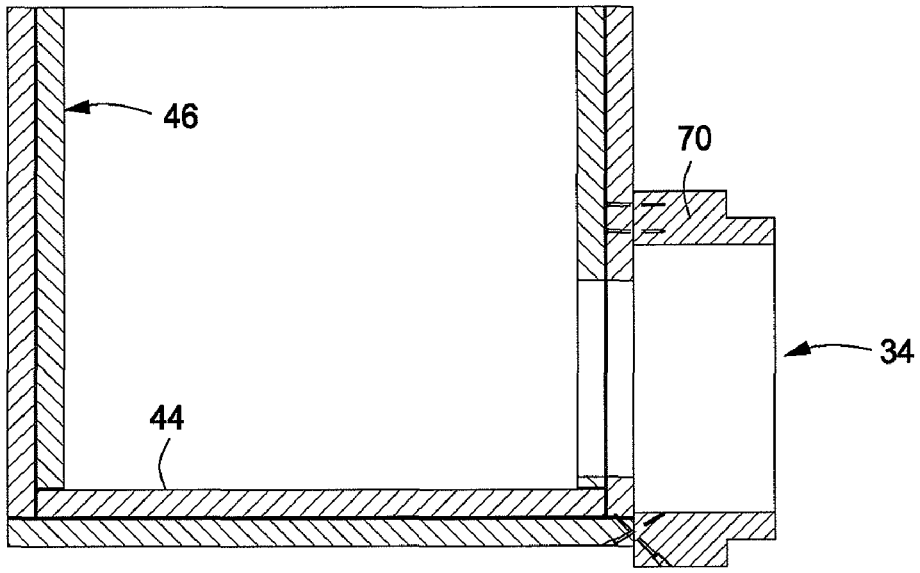
FIG. 4 shows a cross-sectional view of an inner board assembly of the insulating board structure and a containment box of the example board lined furnace shown in FIG. 1.
Figure 5:
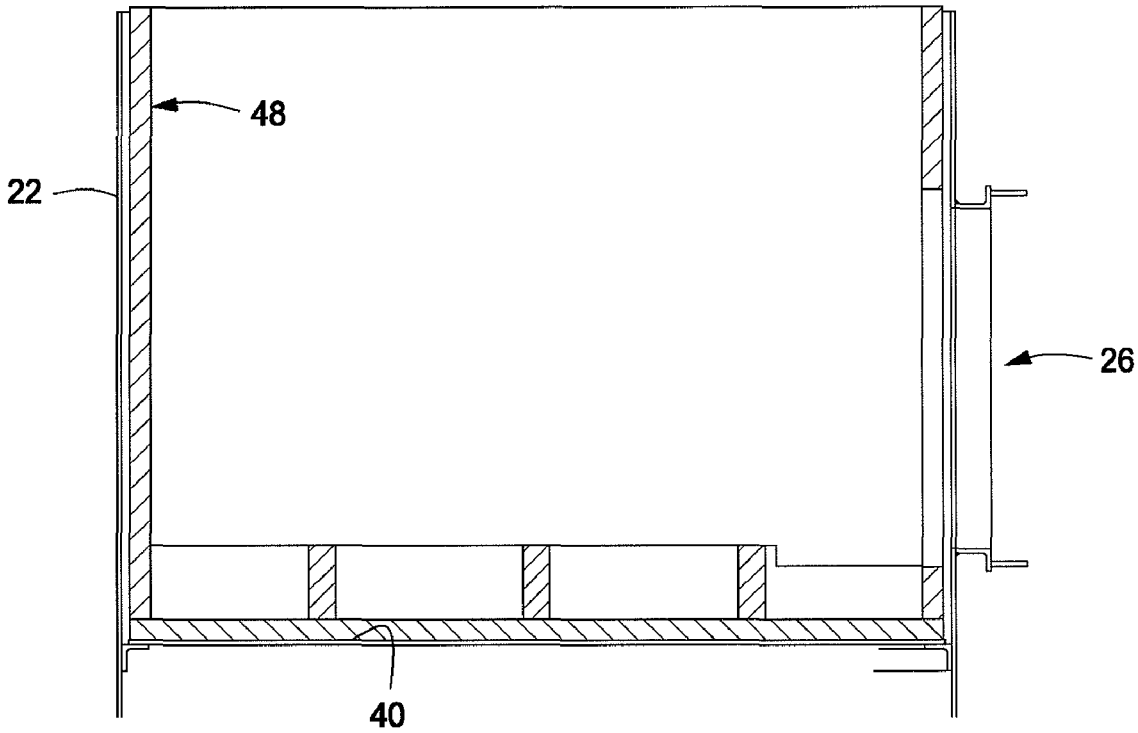
FIG. 5 shows a cross-sectional view of an outer board assembly of the insulating board structure of the board lined furnace shown in FIG. 1 according to an embodiment of the invention.
Figure 6:
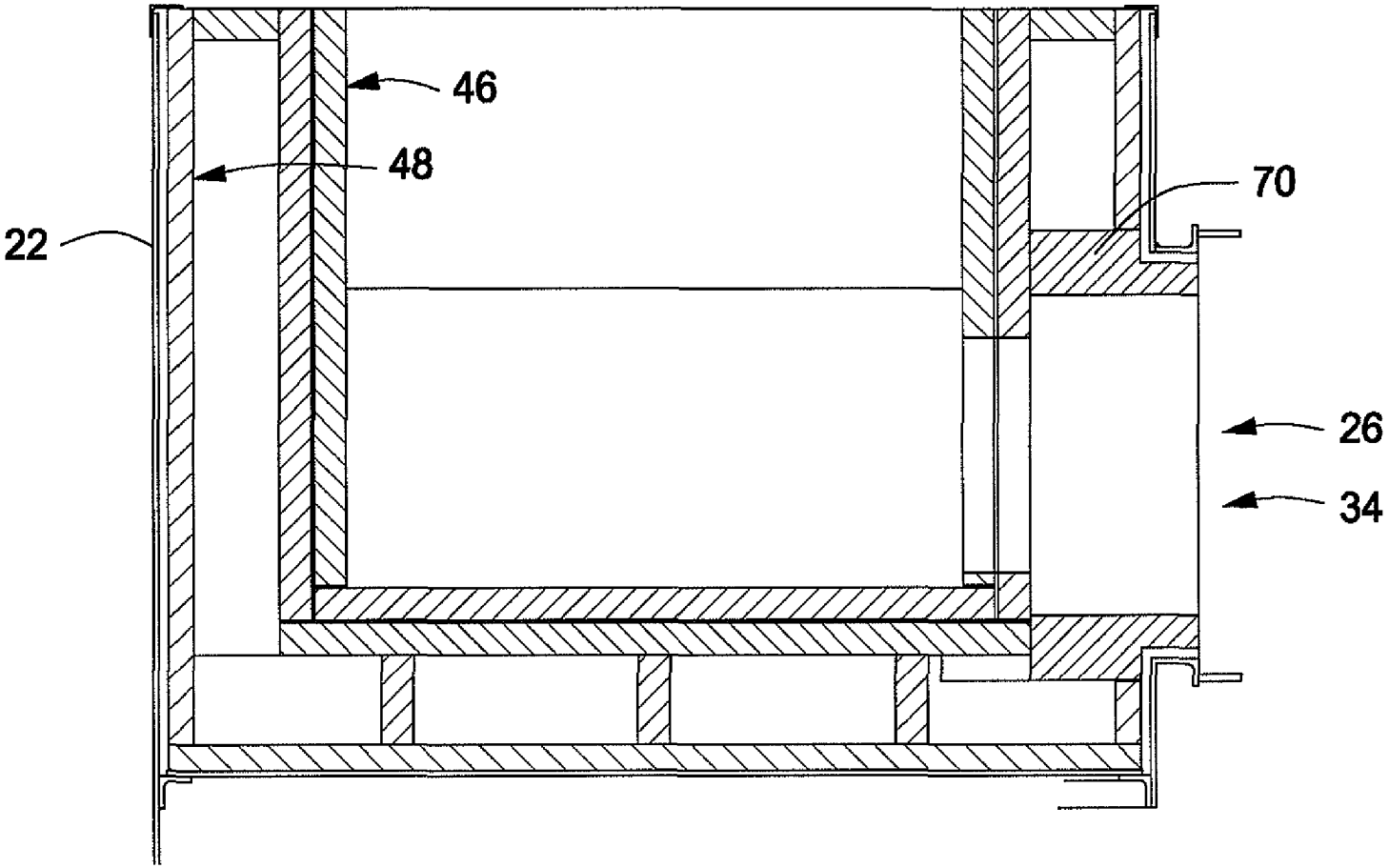
FIG. 6 is a cross-sectional view along line B-B of the board lined furnace shown in FIG. 2 according to an embodiment of the invention.

Having discussed the main components of the board lined holding furnace with a side immersion heating element, the assembly of the components will now be discussed. As shown in FIG. 4, an inner board assembly 46 is constructed with overlaying boards. Mounted to the side of the inner double box assembly of the inner board assembly 46 with screws and non-wetting refractory glue or with any other suitable fastening means, for example, is the board containment box 70. The outer assembly of boards 48, shown in FIG. 5, is arranged in the housing 22. The inner board assembly 46 with the board containment box 70 mounted thereto is thereafter arranged in the outer board assembly 48 in the housing 22, as shown in FIG. 6.

Figure 9:
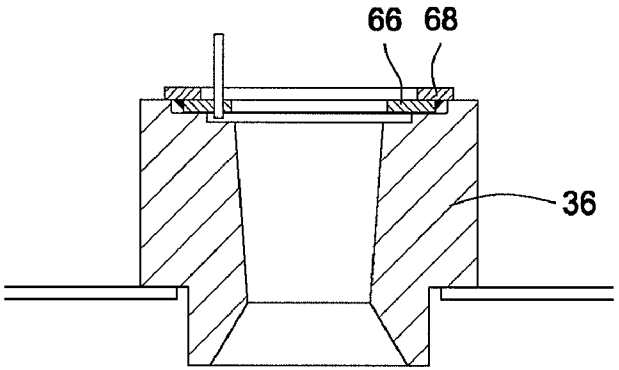
FIG. 9 is a cross-sectional view of the sealing device shown in FIG. 7 with two plates coupled to the block according to an embodiment of the invention.
Figure 10:
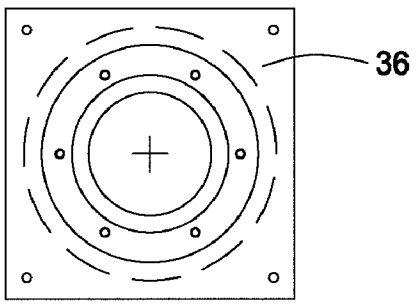
FIG. 10 is a side view of the sealing device shown in FIG. 9 according to an embodiment of the invention.
Figure 7:
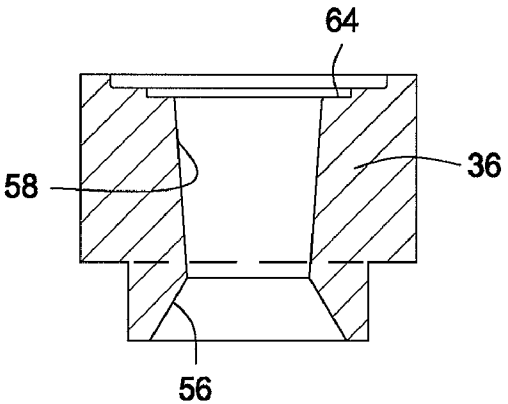
FIG. 7 is a cross-sectional view of a sealing device of the board lined furnace shown in FIG. 1 according to an embodiment of the invention.
Figure 8:
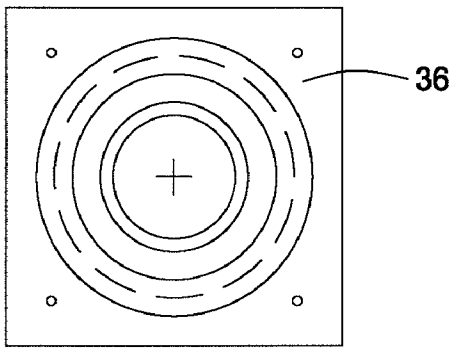
FIG. 8 is a side view of the sealing device shown in FIG. 7 according to an embodiment of the invention.
Figure 12:
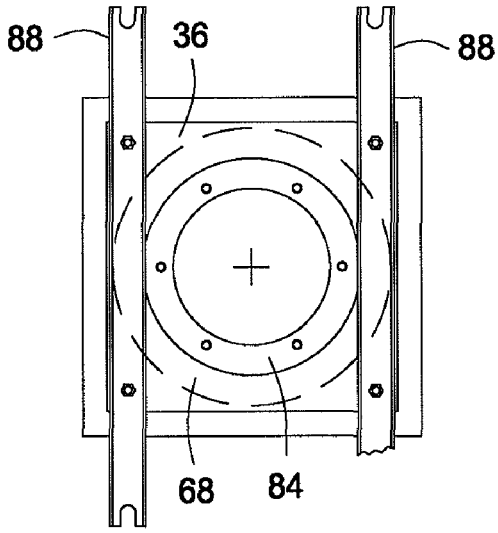
FIG. 12. is a top view of the sealing device and heater assembly shown in FIG. 11 according to an embodiment of the invention.

Referring to FIGS. 7 and 8, the sealing device 36 has two thick metal plates 66, 68 seated in the recessed portion 64 in the terminal end of the sealing device 36, as shown in FIGS. 9 and 10. The metal plates 66, 68 are shaped as annular rings or flanges and are welded together or secured together in any other suitable manner. The dimensions of the plates 66, 68 are chosen to allow room for additional packing of insulating refractory. The plates 66, 68 are mounted to the sealing device 36 with a fastening member, such as a screw. The sealing device 36 with plates 66, 68 already attached is then secured with temporary holding rails 88 (shown in FIGS. 11 and 12), and inserted into side openings 26, 34 provided in the housing 22 and the insulating board structure 28, respectively. The temporary holding rails 88 help to mount the sealing device 36 into the side openings 26, 34 of the housing 22 and insulating board structure 28. The free ends of the holding rails 88 temporarily secure to the housing 22 to hold the sealing device 36 in the selected position.

The joint between the flat on the sealing device 36 behind section 52 is glued to the back of the double inner box assembly of the inner assembly of boards 46 with a special non-wetting cement designed specifically for use with calcium silicate material. A non-wetting plastic refractory, which bonds well with the calcium silicate board and block, is then packed around the sealing device 36, from inside the furnace 20 along the double inner box assembly of the inner assembly of boards 46, and from outside the furnace 20 between the sealing device 36 and the containment box 70 to seal and hold in place the sealing device 36. Then, the temporary holding rails 88 are removed.

Next, the refractory fiber gasket is inserted into the sealing device 36, and the immersion protection tube 76 is placed inside the refractory fiber gasket. Flange 82 of the immersion protection tube is then mounted and slowly tightened into place until the immersion protection tube 76 is supported and the refractory fiber gasket is compressed to approximately half its original thickness, providing a further barrier against leaks. The heating element 74 is inserted into the protection tube 76, and flange 84 of the heating element 74 is mounted and slowly tightened until the heating element 74 is seated and supported.

Figure 14:
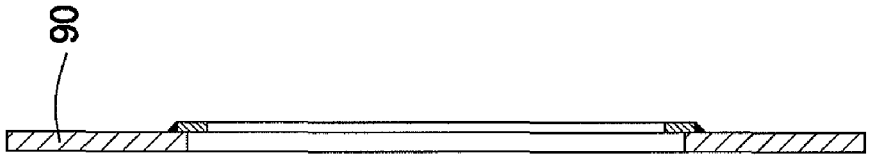
FIG. 14 is a side view of the retaining plate shown in FIG. 13 according to an embodiment of the invention.
Figure 13:
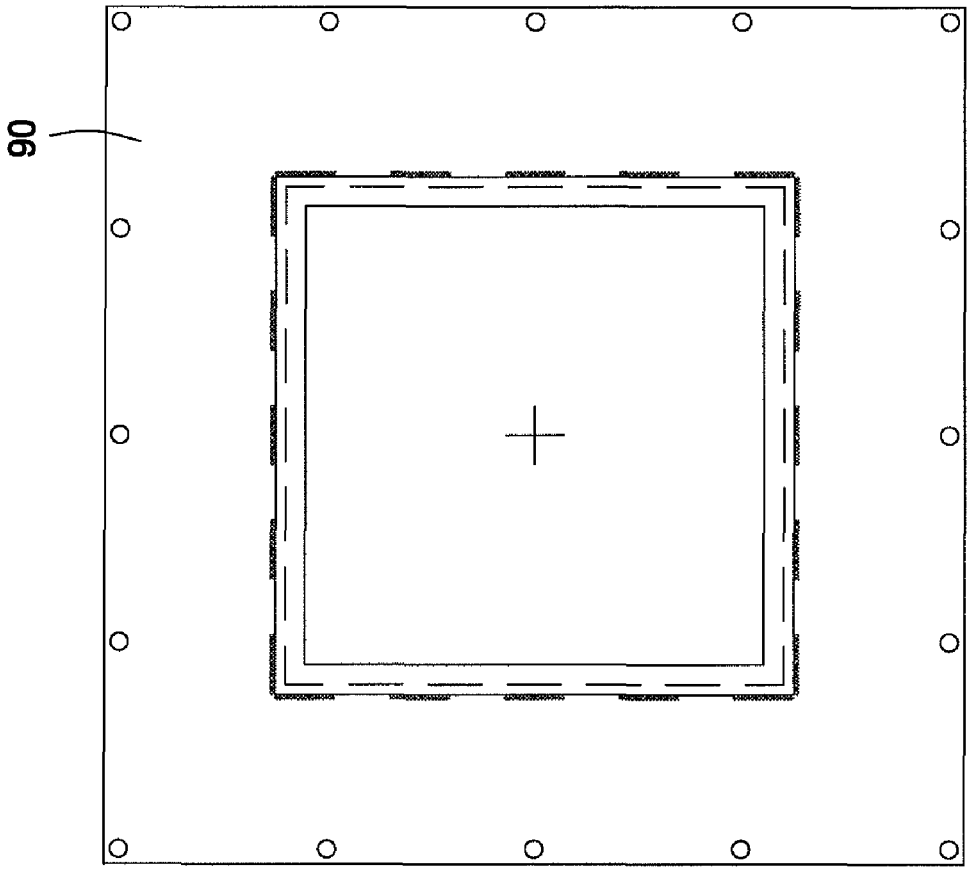
FIG. 13 is a top view of a retaining plate according to an embodiment of the invention.

The final assembly is fastened in place with a retaining plate 90, shown in FIGS. 13 and 14. The retaining plate is bolted on the housing 22 of the furnace 20 (as shown in FIG. 1), and secured to the sealing device 36 having the metal plates 66, 68 attached thereto.

Thus, with the arrangement provided, a board lined holding furnace is provided with immersion heating elements provided in a side thereof that is sealed against leaks.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A holding furnace for holding a molten metal, said furnace comprising:

a housing having an interior chamber for holding the molten metal and an opening into said chamber;

an insulating board structure disposed within said chamber and in overlying relation to at least a side portion of said housing, said insulating board structure being constructed and arranged to contain heat within said housing for maintaining the metal in a molten state;

a heater assembly extending through a side opening of said housing and through a side opening in said insulating board structure into said chamber, said heater assembly being constructed and arranged to be immersed in the molten metal and to transfer heat thereto; and a sealing device disposed in fluid sealing relation to said housing and to said insulating board structure, wherein said sealing device is arranged in said side openings in said housing and said insulating board structure and configured with a multiple step joint along an outer surface thereof to provide a fluid-tight seal, and wherein said sealing device is configured to support said heater assembly.

2. The holding furnace according to claim 1, wherein said insulating board structure is comprised of calcium silicate.

3. The holding furnace according to claim 2, wherein said insulating board structure is comprised of a plurality of calcium silicate boards.

4. The holding furnace according to claim 1, wherein said heater assembly includes a heating element encased in a protective casing.

5. The holding furnace according to claim 4, wherein the protective casing is configured with a flange at a terminal end for securing said protective casing to the sealing device and for providing a sealing joint.

6. The holding furnace according to claim 4, wherein the heating element is configured with a flange at a terminal end for securing said protective casing to the sealing device and for providing a sealing joint.

7. The holding furnace according to claim 1, wherein said side opening in said housing is arranged at a position close to a furnace floor.

8. The holding furnace according to claim 1, wherein said insulating board structure comprises an inner assembly of boards and an outer assembly of boards.

9. The holding furnace according to claim 8, wherein said outer assembly of boards is arranged between said inner assembly of boards and said housing.

10. The holding furnace according to claim 4, wherein the sealing device is configured with a tapered portion configured to match a tapered portion of the protective casing.

11. The holding furnace according to claim 10, wherein the tapered portion of the sealing device and the protective casing are cone-shaped.

12. The holding furnace according to claim 11, wherein the multiple step joint of the sealing device is adjacent portions having different diameters.

13. The holding furnace according to claim 12, wherein the multiple step joint of the sealing device is a round portion adjacent to a square portion.

14. The holding furnace according to claim 4, wherein the protective casing is configured with a multiple step joint.

15. The holding furnace according to claim 1, further comprising a retaining device for retaining the sealing device having the heater assembly secured thereto in a side wall of the furnace.

16. The holding furnace according to claim 1, having three heater assemblies arranged in a side wall of the furnace.

17. A holding furnace for holding a molten metal, said furnace comprising:

a housing having an interior chamber for holding the molten metal and an opening into said chamber;

an insulating board structure disposed within said chamber and in overlying relation to at least a side portion of said housing, said insulating board structure being constructed and arranged to contain heat within said housing for maintaining the metal in a molten state;

a heater assembly extending through a side opening of said housing and through a side opening in said insulating board structure into said chamber, said heater assembly being constructed and arranged to be immersed in the molten metal and to transfer heat thereto; and a sealing means disposed in fluid sealing relation to said housing and to said insulating board structure, wherein said sealing means is arranged in said side openings in said housing and said insulating board structure and configured with a multiple step joint along an outer surface thereof to provide a fluid-tight seal, wherein said sealing means is configured to support said heater assembly.

18. The holding furnace according to claim 17, wherein said insulating board structure is comprised of calcium silicate.

19. The holding furnace according to claim 18, wherein said insulating board structure is comprised of a plurality of calcium silicate boards.

20. The holding furnace according to claim 17, wherein said heater assembly includes a heating element encased in a protective casing, and the protective casing is configured with a tapered sealing surface.

21. The holding furnace according to claim 1, and wherein said sealing device defines a tapered cone containing at least portion of the heater assembly, the tapered cone diverging, toward the interior chamber and converging toward the sealing device.

22. The holding furnace according to claim 17, and wherein said sealing means defines a tapered cone containing at least portion of the heater assembly, the tapered cone diverging, toward the interior chamber and converging toward the sealing means.

* * * * *